United States Patent [19]

Schubring et al.

[11] Patent Number: 4,535,310

[45] Date of Patent: Aug. 13, 1985

[54] PNEUMATIC TIMING ATTACHMENT FOR AN ELECTROMAGNETIC DEVICE

[75] Inventors: Allin W. Schubring, Milwaukee; Robert W. Sehmer, Grafton, both of Wis.

[73] Assignee: Square D Company, Palatine, Ill.

[21] Appl. No.: 528,906

[22] Filed: Sep. 2, 1983

[51] Int. Cl.[3] ..... H01H 7/03

[52] U.S. Cl. ..... 335/61; 335/59; 116/307

[58] Field of Search ..... 335/59, 60, 61, 62, 335/63, 64, 67; 200/34; 116/279, 306, 307

[56] References Cited

U.S. PATENT DOCUMENTS 3,249,716 5/1966 Haydu et al. ..... 335/61

3,509,501 4/1970 Brovedan ..... 335/61

*Primary Examiner*—E. A. Goldberg

*Assistant Examiner*—George Andrews

*Attorney, Agent, or Firm*—William H. Schmeling

[57] ABSTRACT

A timing attachment for a relay that is programmable to provide an ON Delay or an OFF Delay operation of a pair of switches having either normally open or normally closed contacts. The attachment includes a housing that is mountable in either of two positions on an assembly that is attached to the relay to program the OFF and ON Delay timing functions and indicia on the switches that indicate the contact operation of the switches when the switches are inserted in sockets in the attachment. A cover for the attachments has openings there through that expose indicia on the switches indicating the normally open and normally closed operating condition of the switches when the switches are inserted into the sockets and a slider that is movable along a rear surface of the cover to positions indicating the programmed operation of the attachment and the mode of operation of the switches when the attachment is mounted on the relay.

19 Claims, 31 Drawing Figures

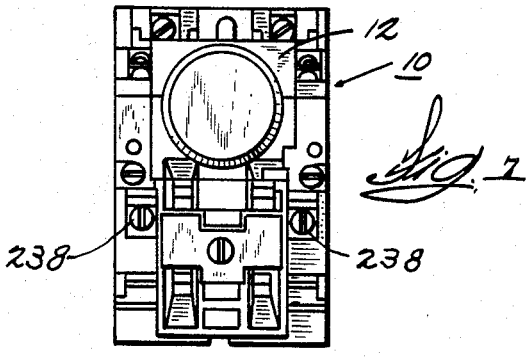
Fig. 7
Fig. 8
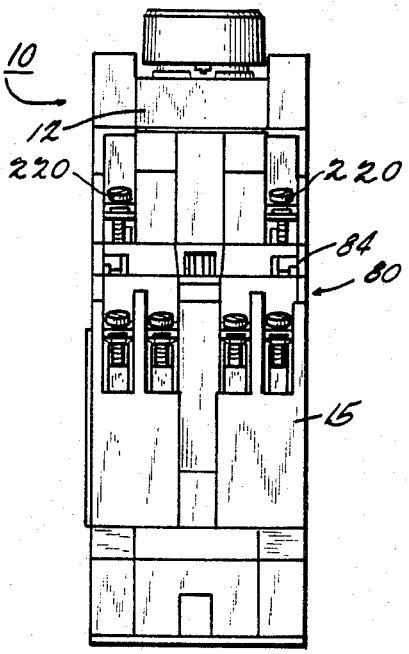
Fig. 9
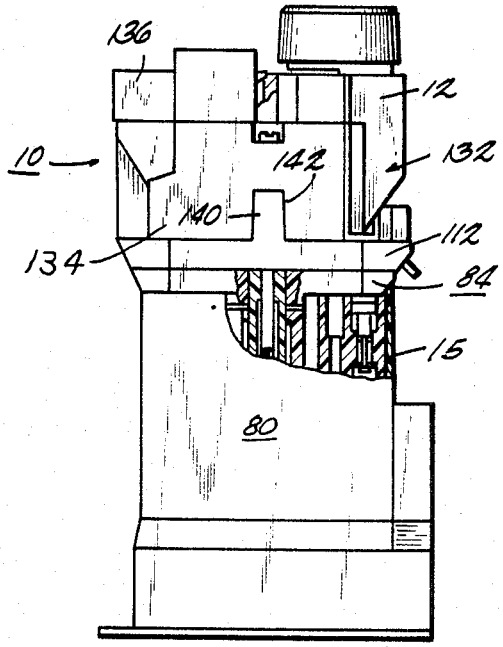

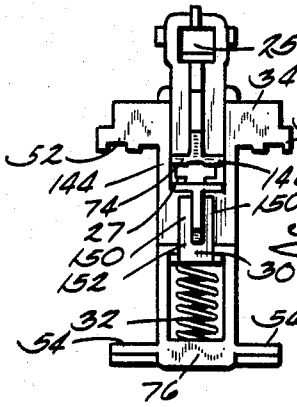
Fig. 19A
Fig. 27
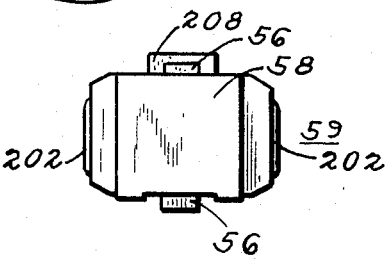
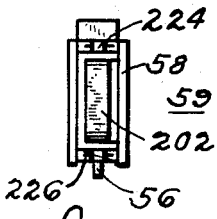
Fig. 29
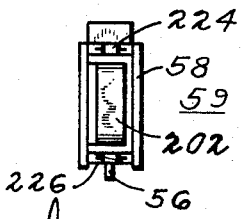
Fig. 30
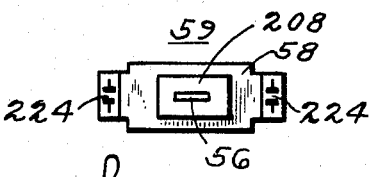
Fig. 28

Fig. 22.
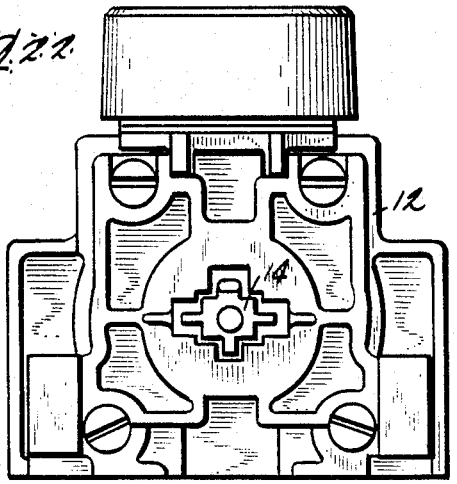
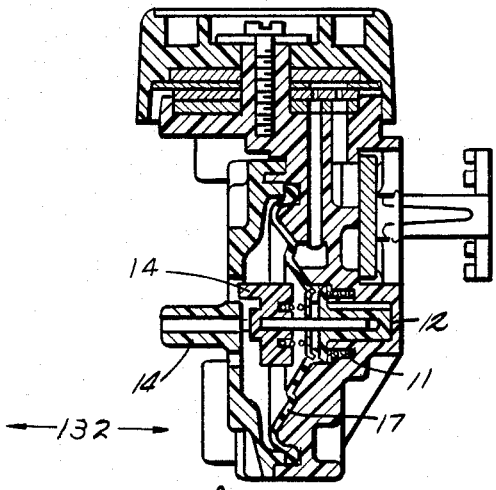
Fig. 23.
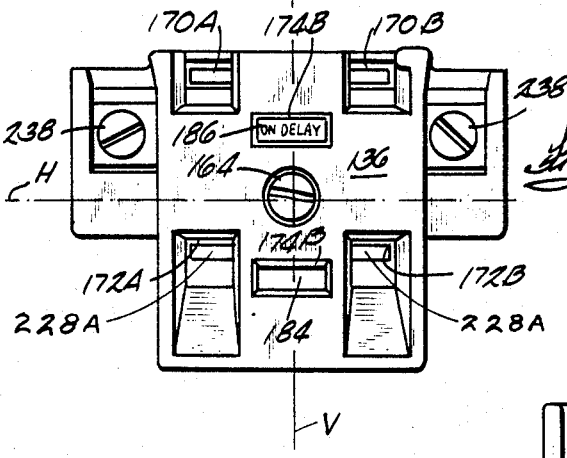
Fig. 24.
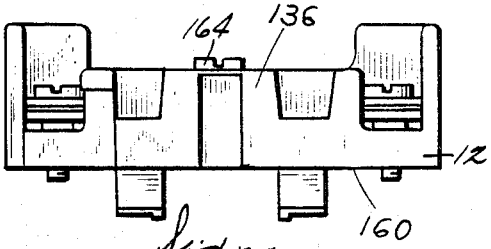
Fig. 25.
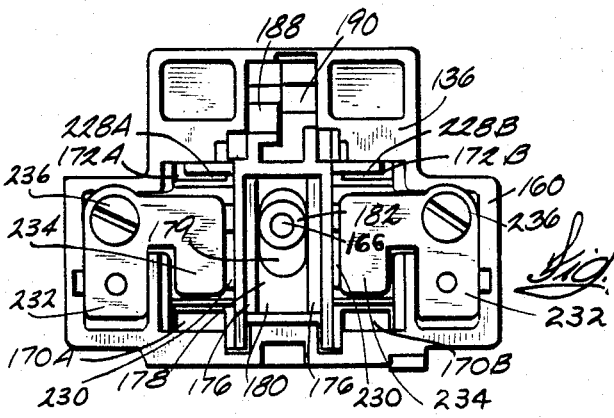
Fig. 26.

PNEUMATIC TIMING ATTACHMENT FOR AN ELECTROMAGNETIC DEVICE

This invention relates to pneumatic timers and is more particularly concerned with a timing attachment for use in connection with electromagnetically actuated devices, such as relays, contactors and the like, to provide either an OFF DELAY or ON DELAY operation for either normally open or normally closed switching contacts in response to the energization or deenergization of the device. The invention is directed to a mechanism which will positively drive the switching contacts to their closing or opening position and an arrangement which will designate the programmed operation of the timing mechanism and the switch cartridges as used in the timing attachment.

The use of pneumatic timing attachments in connection with devices such as relays, contactors and the like, to provide a time delay operation of switching contacts after a device is energized or deenergized is well known and is usually accomplished by mounting the attachment on the structure carrying the instantaneous switching contacts of the device. One form of a timing attachment is illustrated by U.S. Pat. No. 3,254,177, granted to R. F. Gottsacker et al, on May 31, 1967. While the time device as disclosed in the Gottsacker patent has proved satisfactory in many respects, the attachment includes a single pole double throw switch and is therefore capable of only providing a normally open and a normally closed contact operation. In the device according to the present invention, a pair of switches having either normally open or normally closed contacts are used to overcome the deficiency noted in the Gottsacker structure. Another type of pneumatic timing attachment for a relay is illustrated in U.S. Pat. No. 4,030,054 issued on June 14, 1977 and is assigned by the inventor Rudolph H. Kiessling the assignee of the present invention. While the timing attachment according to the Kiessling patent has also proven satisfactory in the market place, the timing attachment included several parts which were very difficult to manufacture. The attachment according to the present invention overcomes the disadvantages noted in the Kiessling structure.

It is an object of the present invention to provide a timing attachment wherein the attachment is mounted on the front side of its associated electromagnetically operated device without reducing the number of switching contacts of the device.

An additional object is to provide a timing attachment that has wiring terminals arranged so the device has input terminals located along one side of the device and output terminals along the opposite side of the device and switch cartridges that are insertable in either of two positions in a socket and are accessible when a cover for the attachment is removed.

Another object is to provide a timing attachment that has wiring terminals arranged so the device has input terminals along one side of the device, output terminals along the opposite side of the device and switch cartridges that are insertable in either of two positions in sockets so that the switch cartridges are easily accessible when a cover for the attachment is removed and to provide the attachment with an adapter and a base which are secured in either of two positions relative to each other to program the attachment to provide a time delay after energization or time delay after deenergization mode of operation.

A further object is to provide a timing attachment that has wiring terminals arranged so the device has input terminals located along one side of the device, output terminals along the opposite side of the device and switch cartridges that are insertable in either of two positions in sockets which are accessible when a cover for the attachment is removed and to provide the attachment with an adapter and base which are secured in either of two positions relative to each other to program the attachment to provide a time delay after energization or time delay after deenergization mode of operation and to provide a cover for the attachment with openings which are closable by a slider when slider is moved to a position indicating the programmed operation of the switch cartridges.

Further objects and features of the invention will be readily apparent to those skilled in the art from the specification and the appended drawings illustrating a preferred embodiment in which a pneumatic timing attachment for an electromagnetic device incorporating the features of the present invention is diagrammatically shown.

DESCRIPTION OF THE DRAWINGS

FIG. 7 is a top view of a timer attachment according to the present invention as attached to a front side of a electromagnetic device.

FIG. 8 is an end view of the device in FIG. 7.

FIG. 9 is a side view of the device in FIG. 8 with portions of the device broken away.

FIG. 19 is a front view and FIG. 19A is a rear view of an assembly including an operator, a slide, a spring guide as detached from the base assembly shown in FIG. 17.

FIG. 22 is a view of a timer module as used with the attachment in FIG. 9.

FIG. 23 is a cross sectional view of the timer module as shown in FIG. 22.

FIG. 24 is a top or front view of a cover that is used with the attachment in FIG. 9.

FIG. 25 is an end view of the cover in FIG. 24 and

FIG. 26 is a view of the bottom or rear view of the cover as in FIG. 25.

FIGS. 27–30 respectively are a side, a top, or a left and a right end view of a switch cartridge that is inserted into a housing part shown in FIGS. 17 and 18.

Figure 1:
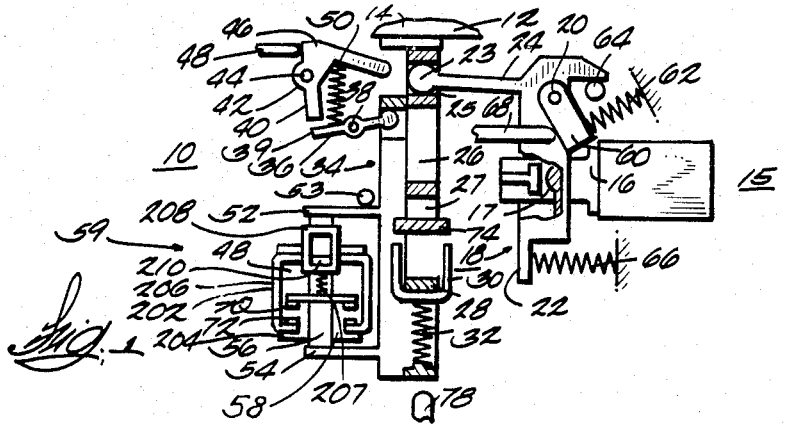
FIGS. 1–3 are functional diagrams of the timing attachment according to the present invention when the attachment is programmed to provide a time delay function after energization of its associated electromagnet device.

A time delay mechanism 10 as shown in FIG. 1 includes a timing head 12 and an electromagnetic relay 15. The timing head 12 controls the movement of a timing button 14 and the relay has a movable armature 16 connected through a lost motion connection 17 with a bellcrank 18. The bellcrank 18 has an intermediate portion rotatable about a pivot 20 and a crank arm 22 connected through the lost motion connection 17 with the armature 16. The bellcrank 18 also has a crank arm 24 extending from the pivot 20 to a ball or cylinder 23. The ball 23 has a ball and socket type connection with a socket 25 in a slider 26. The slider 26 has a portion 74 engageable with a guide 30 through a lost motion engagement. The guide 30 is operatively connected through a spring 32 with an operator 34. The operator 34 is connected through a ball and socket type connection with an arm of a latch lever 36. The latch lever 36 is rotatable about a pivot 38 and has a second arm 39 engageable with an arm 40 on a latch 42. The latch 42 is rotatable about a pivot 44 and has an arm portion 46 that engages a stop 48 as well as the button 14. A compression spring 50, positioned between the arm 46 and the arm 39, biases the arm 46 toward engagement with the stop 48.

The operator 34 has portions 52 and 54 that are suitably spaced to engage opposite ends of a contact carrier or plunger 56. The carrier 56 is movable within a switch housing 58 of a switch 59. The upward movement of the portion 52 is limited by a stop 53. The time delay mechanism 10 also includes a lever 60 which rotates about the pivot 20 and is engagable with the crank arm 22. The lever 60 is biased by a spring 62 to urge the lever 60 and bellcrank lever 18 in a clockwise direction. The crank arm 22 is engageable with a stop 64 and is biased by a spring 66 in a clockwise direction toward engagement with the stop 64.

Figure 2:
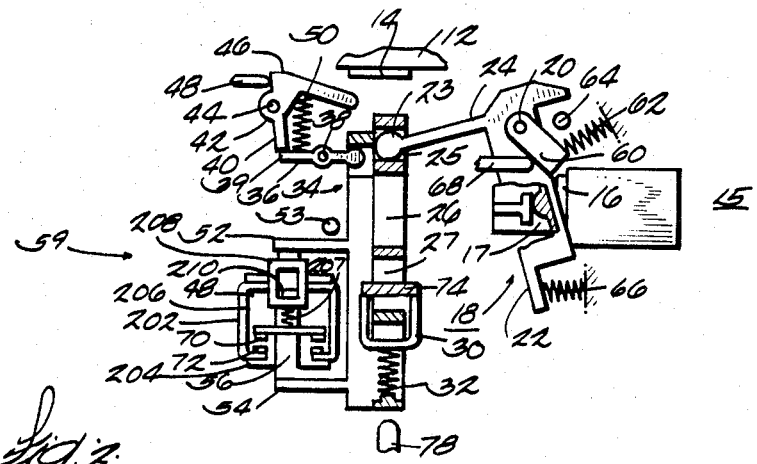
Figure 3:
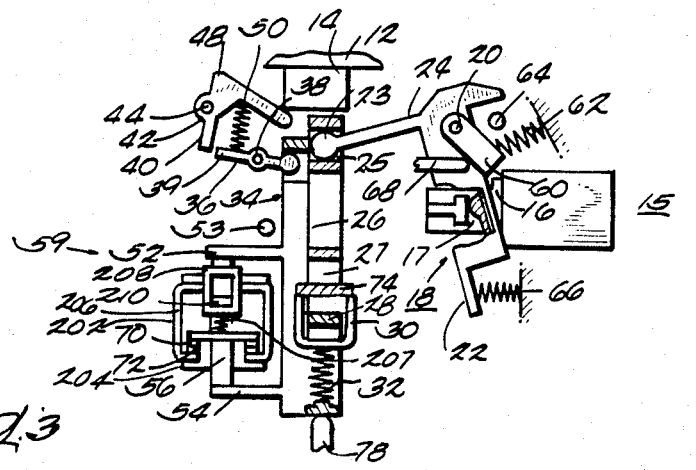
Figure 4:
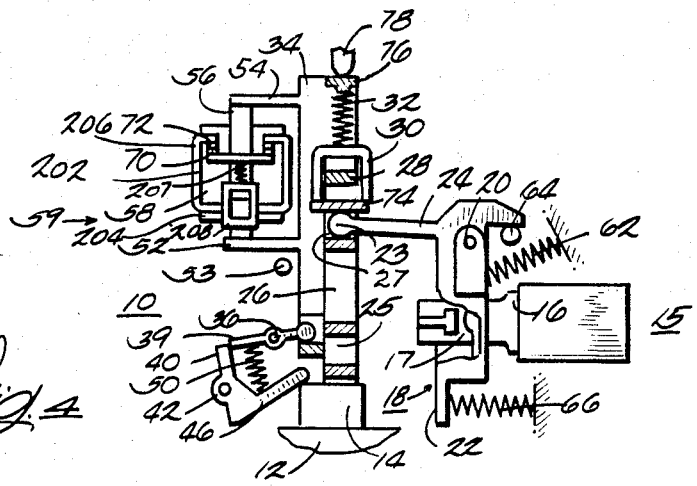
FIGS. 4–6 are functional diagrams showing the components of the attachment depicited in FIGS. 1–3 when the components are programmed to provide a time delay after its associated device is deenergized.
Figure 5:
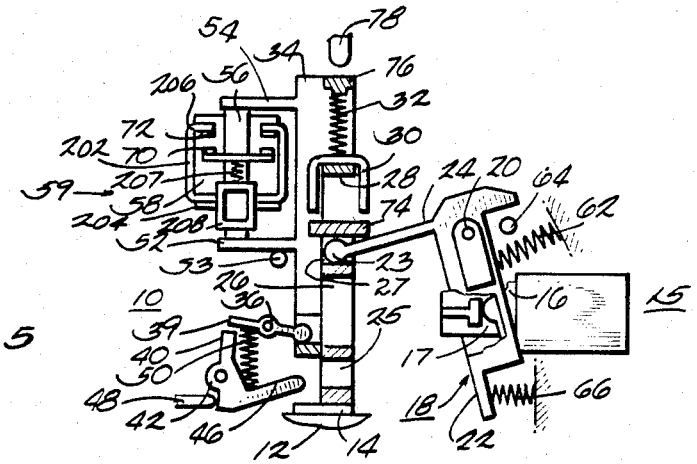
Figure 6:
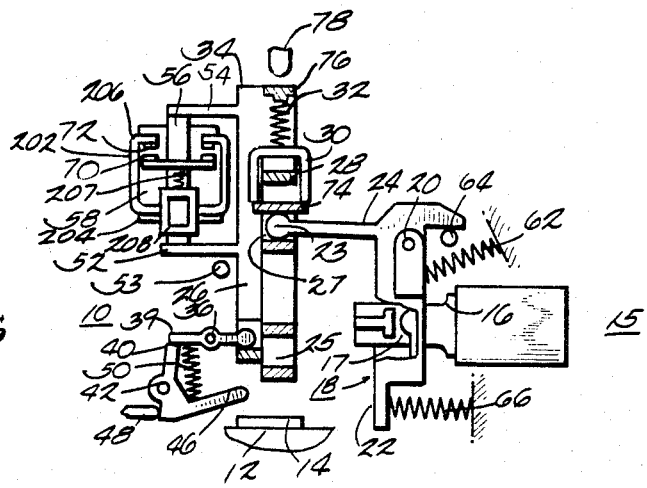

The time delay mechanism 10 may be programmed to provide a time delay function after energization of the relay 15 as shown in FIGS. 1,2, and 3, or provide a time delay function after the relay 15 is deenergized when the components of the mechanism 10 are positioned as shown in FIGS. 4,5, and 6. When the mechanism 10 is programmed to provide a time delay after the relay 15 is energized, the parts are positioned as in FIGS. 1–3, wherein the ball 23 on the free end of the crank arm 24 is positioned in the socket 25. When the components are arranged to provide a time delay after deenergization of the relay 15, the components are arranged as shown in FIGS. 4–6 wherein the ball 23 is received in a socket 27 in the slider 26.

When the components of the time delay mechanism 10 are positioned as shown in FIGS. 1–3, a stop 68 positions the lever 60 at a location where the lever 60 is disengaged from the crank arm 22 and therefore does not contribute a force supplied by a spring 62 to the force supplied by the spring 66 on a crank arm 22. When the mechanism 10 is deenergized as shown in FIG. 1, the spring 66 will position the crank arm 22 against the stop 64 as the ball 23, because of its position in socket 25, positions the slider 26, the guide 30, and the operator 34, at their respective top most positions as in FIG. 1 whereat the upper end of the slider 26 engages and moves the timing button 14 upwardly into a retracted position in the timing head 12. When the operator 34 is at its top position, the latch lever 36 is moved to a position where the arm 39 is spaced from and is positioned to be engaged by the arm 40 on the latch 42. Also, when the operator 34 is in its top position, the portions 52 and 54 will locate the contacts 70 in one of their three positions in the switch housing 48 e.g. where the movable contacts 70 in the switch housing 48 are separated from stationary contacts 72. Alternatively, switch 59 can be inverted relative to portions 52 and 54 to reverse the position and the operation of the contacts 70 and 72.

When the relay 15 is energized, the components including the armature 16 and the connection 17 are moved to the right from the position shown in FIG. 1 to the position shown in FIG. 2. The movement of armature 16 causes the bellcrank lever 18 to rotate counterclockwise about the pivot 20 to a position where the spring 66 is compressed as the lever 24 moves out of engagement with the stop 64. The counterclockwise rotation of the lever 18 through the ball 23 and socket 25 connection causes the slider 26 to move downwardly out of engagement with the timing button 14 to the position shown in FIG. 2 and initiate the beginning of a timing interval. The downward movement of the slider 26 causes a portion 74 on the slider 26 to move from a position where it is separated from the guide 30 to a position where it engages the guide 30 and moves the guide 30 downwardly out of its engaging position with the portion 28 as it compresses the spring 32. The compressed spring 32 causes the operator 34 to move downwardly a slight distance and the latch lever 36 to rotate in a clockwise direction to a position where the arm 39 engages the arm 40 so that the latch lever 36 and the latch 42 prevents further downward movement of the operator 34. In this connection, it should be noted that the slight downward movement of the operator 34 is insufficient to cause the movable contacts 70 to engage the stationary contacts 72.

The components within the timing head 12 control the rate at which the timing button 14 moves from a retracted position where it is spaced from the arm 46 as in FIG. 2 to an extended position shown in FIG. 3 where it engages and rotates the arm 46 clockwise about the pivot 44 and releases its latching engagement with the arm 39 and terminates the time delay period which was initiated when the relay 15 was energized. The disengagement between the latch lever 36 and the latch 42 permits the lever 36 to rotate in a clockwise direction in response to the stored energy force supplied by the compressed spring 32. The spring 32 reacts between the guide 30 and a portion 76 on the operator 34 and is initially compressed when the slider 26 and the guide 30 move downwardly in response to the energized relay 15. The downward movement of the operator 34 to the position shown in FIG. 3 causes the portion 52 to move the contact carrier 56 downwardly to a position where the movable contacts 70 engage the stationary contacts 72. The downwardly movement of the operator 34 is limited by a stop 78 which is engaged by the portion 76.

The time delay mechanism 10 may be programmed to provide a time delay after the relay 15 is deenergized by inverting the position of the timing head 12, the slider 26, the guide 30 including the spring 32, the operator 34 including the latch lever 36, the latch 42, and the switch housing 58 relative to the bellcrank 18 from the position shown in FIG. 1 to the position shown in FIG. 4. The programming of the device 10 is accomplished by positioning the ball 23 in a socket 27 instead of the socket 25 as shown in FIG. 4. When the parts are thus positioned and the relay 15 is deenergized, the lever 22 engages the stop 64 and positions the slider 26 at its upper position where the portion 74 engages the guide 30 and moves the guide 30 against the compressive force exerted by the spring 32 so the portion 76 on the operator 34 engages the stop 78. When the operator 34 is thus positioned, the contact carrier 56 is positioned by the portion 52 so the movable contacts 70 engage the stationary contacts 72. Also when the slider 26 is at its upper position, the timing button 14 will be timed out and at its furthest extended position relative to the timing head 12 and the latch 42 is at a disabled position whereat the arm 40 is disengaged from its latching position relative to the arm 39 and the latch lever 36 is at its furthest counter clockwise position to a position whereat the operator 34 engages the stop 78 and the spring 32 remains compressed. When the device is programmed to operate in the time delay after deenergization mode, the stop 68 is withdrawn and the lever 60 engages the bellcrank lever 18 with a force supplied by the spring 62 as well as the spring 66.

The energization of the relay 15 causes the relay armature 16 to move to the right from the position shown in FIG. 4 to the position shown in FIG. 5 and the bellcrank lever 18 to rotate in a counter clockwise direction from a position whereat the crank arm 22 engages the stop 64 to a position where the springs 62 and 66 are compressed. The rotation of the lever 18 through the connection provided by the ball 23 and the socket 27 moves the slider 26 downwardly and the timing button 14 to move to a retracted position in the timing head 12. The downward movement of the slider 26 permits the guide 30 to movement downwardly to engage the stop 28 and operator 34 to move downwardly to engage a stop 53 in response to a force supplied by springs 56 and 50. The downward movement of operator 34 and slider 26 permits reengagement of latch 42 and latch lever 36. Rotation of the latch 42 and the latch lever 36 is clockwise except for the latch 42 which has to briefly reverse its direction of rotation for a brief time interval during its initial clockwise motion.

The deenergization of the relay 16 causes the components of the time delay mechanism to move from the position shown in FIG. 5 to the position shown in FIG. 6. The deenergization relay 15 permits the forces supplied by the springs 62 and 66 to rotate the lever 18 clockwise and engage the stop 64 and thus initiate a timing period. The clockwise rotation of the lever 18, as transmitted to the slider 26 through the connection provided by the ball 23 and the socket 27, causes the slider 26 to move upwardly to a position shown in FIG. 6.

The clockwise rotation of the lever 18 causes an engagement between the portion 74 and the guide 30 and moves the guide 30 out of engagement with the portion 28. The movement of the guide 30 compresses the spring 32 as the operator 34 is restrained from movement upwardly by the latch lever 36 and the latch 42. During the timing period, the operator 34 is restrained from upward movement while the movable contacts 70 remain separated from the stationary contacts 72. During the timing period, the button 14 moves upwardly at a rate controlled by the timing head 12. The timing period ends when the button 14 engages the arm 46 and moves the latch 42 in a counterclockwise direction and disengage the latch 42 from the latch lever 36 so that the operator 34 is free to move upwardly by the force supplied by the compressed spring 32 to a position where the movable contacts 70 engage the stationary contacts 72 to terminate the timing period.

The spring 56 within the housing 58 reacts on the movable contacts 70 and supplies a force that increases the engagement between the movable and stationary contacts 70 and 72 respectively. The spring 50 is positioned between the arms 39 and 46 to provide a force constantly urging latch lever 37 and latch 42 toward rotation in a counter clockwise direction in FIGS. 1–3 and in a clockwise direction in FIGS. 4–6. The spring 32 is positioned between the spring guide 30 and the portion 76. The portion 76 is a part of the operator 34 and the spring 32 constantly urges the spring guide 30 into engagement with portion 28 of the operator 34 and transmits movement of the slider 26 to the operator 34. The spring 66, positioned between a properly located support and the bellcrank lever 18, constantly urges the lever 18 in a clockwise direction toward stop 64. The spring 62 operates between the support and the lever 60. The springs 62 and the lever 60 are inoperative when the mechanism 20 is programmed in the TDE mode as in FIGS. 1–3. When the mechanism 10 is programmed to operate in the TDD mode the spring 62 assists the spring 66 to provide a force necessary to move the components from the position shown in FIG. 5 to the position shown in FIG. 6.

The components of the time delay mechanism or attachment 10 which are functionally illustrated in FIGS. 1–6 and heretofore described are illustrated in their mechanically executed form in FIGS. 7–30. The same numeral designations of the items in FIGS. 1–6 are used to designate corresponding items in FIGS. 7–30.

The time delay mechanism 10 as shown in FIGS. 7, 8 and 9 is shown as mounted on in electromagnetically device which is preferably a relay 80. A relay 80 which is particularly suited to be used with the timer attachment 10 is described as shown in the U.S. application Ser. No. 411,387 issued as U.S. Pat. No. 4,479,102 on Oct. 23, 1984 which was filed on Aug. 25, 1982 and is assigned by the inventors,Kenneth J. Marien and Wynn R. Lemke to the assignee of the present invention.

Figure 12:
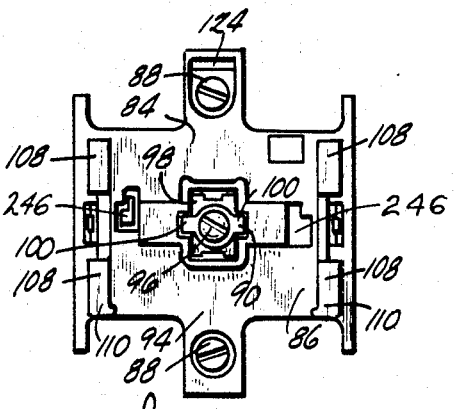
FIG. 12 is a top view of an adapter assembly used with the attachment as illustrated in FIG. 9.
Figure 13:
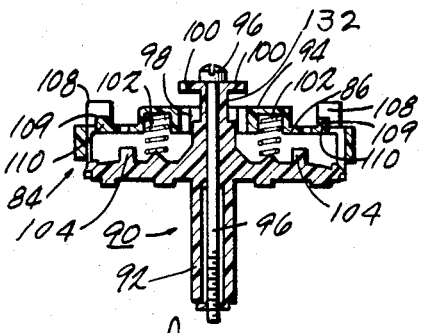
FIG. 13 is a cross-sectional view of the adapter shown in FIG. 12.

When the relay 80 receives the delay mechanism 10, the conventional cover of the relay is replaced by an adapter 84 shown in FIGS. 12 and 13 that includes a cover part 86 that is secured to the front end of the relay by a pair of screws 88. The adapter also includes a plunger member 90 that has a stem portion 92 secured to a front end of a member, not shown, included as a part of the relay 80 by a screw 96. The member including the screw 96 is movable along an axis perpendicular to the front end of the relay 80 by an electromagnetic, not shown, from a deenergized position to an energized position in response to the deenergization and energization of the electromagnet. The stem portion 92 extends through an opening 98 in the cover part 86 to an end that is provided with a pair of oppositely extending arms 100 that are spaced forwardly of the front surface 94 of the cover part 86. In the embodiment shown, a pair of springs 102 positioned between a rear surface on the cover part 86 and a pair of arms 104 on the plunger member 90 constantly urge the member 90 in a direction to assist the relay 80 when the relay 80 is energized and the member 90 is moved downwardly in response to the energization of the electromagnetic portion of the relay 80.

The part 86 shown in FIG. 12 includes four hook portions 108 extending forwardly of the front surface 94 providing grooves that have an end opening facing an end 110. Two of the openings 109 are shown in FIG. 13. As will be later described the hook portions 108 together with the openings 109 provide a hook and slide arrangement for maintaining a base assembly 12 assembled on the part 86.

Figure 16:
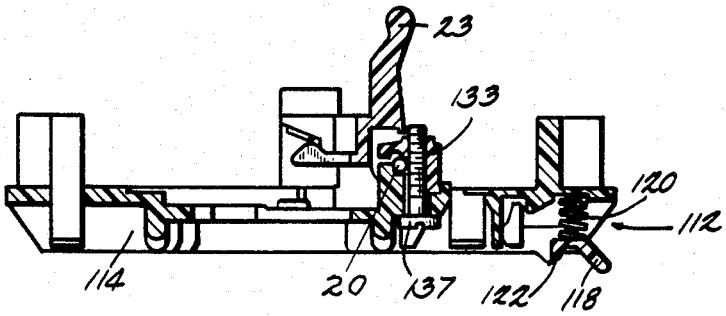
FIGS. 15 and 16 are cross-sectional views taken along lines 15—15 and 16—16 respectively in FIG. 14
Figure 15:
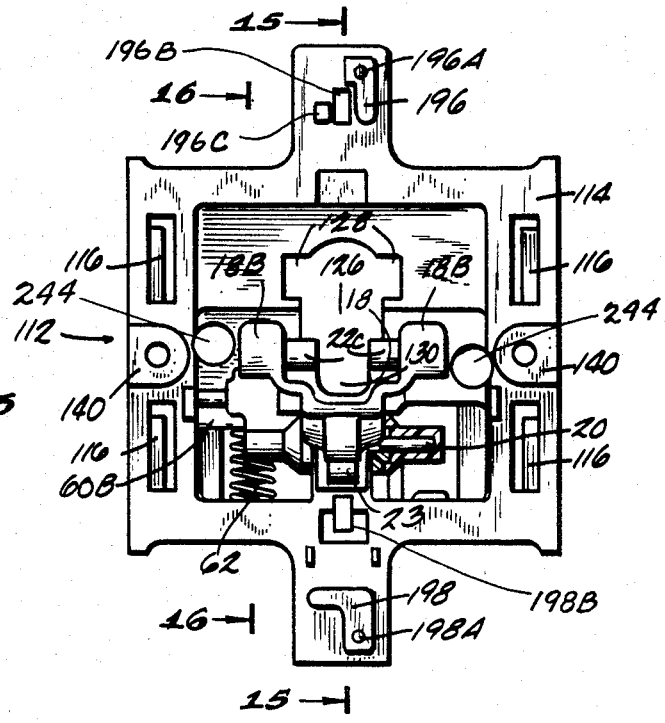
Figure 14:
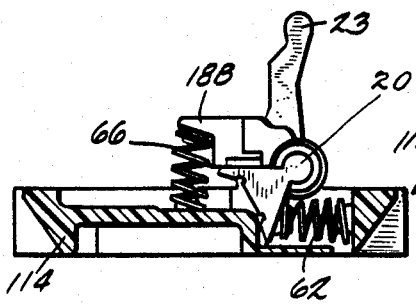
FIG. 14 is a front or top view of a base assembly used with the attachment shown in FIG. 9.

A base assembly 112 as shown on FIGS. 14–16 is provided by a body portion 114 that has a rear surface positioned on the front surface 94 of the adapter 84. The body portion 114 has hook portions 116 that cooperate with the hook portions 108 to locate the body portion 114 on the adapter 84 with the hook and slide connection. The hook and slide connection between the portions 108 and 116 is maintained by a catch comprising a lever 118 that is pivoted on the body portion 114 and biased by a spring 120 that urges the lever 118 toward a position where a latch surface 122 on the lever 118 is positioned in recess 124, shown in FIG. 12, to maintain the adapter 84 and the base assembly 112 assembled after they are moved with a sliding action into an assembled position wherein the hook portions 108 and 116 are in hook and slide engagement and the latch lever 118 is an engagement with the latch surface 124.

The body portion 114 is provided with a cruxiform shaped opening 126. Opening 126 has a pair of arm portions 128 and a stem portion 130 that provide passage for the arms 100 and a stem portion on the plunger member 90 when the body portion 114 is moved into position relative to the cover part 86. The movement of the body portion 114 into position on cover part 86 causes the arms 100 to move into position on a front side on a pair of surfaces 22C on the bell crank 18 to provide a connection between the plunger member 90 and the bell crank 18. The previously described bellcrank 18 in FIG. 14 and lever 60 are mounted on a common pivot 20 at the front surface of the body portion 114. The bellcrank lever 18 is constantly urged to rotate in a clockwise direction, as in FIG. 16, by a pair of springs 66, one of which shown, which are positioned between the front surface of the body portion 114 and a pair of portions 18B as shown in FIG. 14. The pivot 20 is maintained in position by a suitably shaped block 134 that is secured at the front side of the body portion 114 by a screw 136. A pair of springs 62, one of which is shown in FIG. 16, positioned between the body portion 114 and portions 60B on the lever 60 constantly bias the lever 60 into engagement with the bellcrank 18 and assists the springs 66 when the lever 60 is in an operative position. The surfaces 22C are located on arms corresponding to the arm 22 in FIG. 1 so that movement by the plunger 90 rotates the bellcrank 18 against the force of springs 66 when the plunger 90 moves downwardly.

Figure 19:
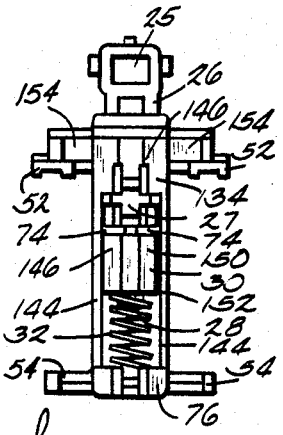
Figure 20:
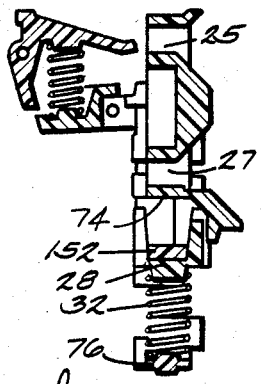
FIG. 20 is a cross section view taken along line 20—20 in FIG. 19.
Figure 21:
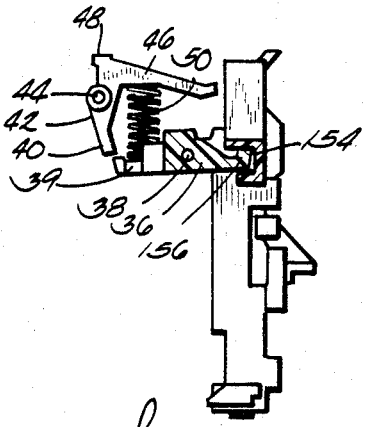
FIG. 21 is a cross section view taken along 21—21 in FIG. 19.

A timer assembly 132 includes a housing part 134, as shown in FIG. 9, the timing head 12 and a cover 136 that are securable in either of two positions on the base assembly 112. The timer assembly 132 is most clearly shown in FIGS. 17–21 and 19A. The housing part 134 has a rear side 138 positioned on the front surface side of the body portion 114. The position of the housing part 134 on the body portion 114 is indexed by a pair of bosses 140 extending forwardly on the body portion 114 which are received in suitable recesses 142 that extend in the side walls of the housing part 134. The bosses 140 and the recesses 142 are arranged so that the housing part 134 may be positioned in either of two selected positions on the base assembly 112. The operator 34 previously described in connection with FIGS. 1–6 and shown in FIGS. 17, 19A and 19–21 is substantially U-shaped having a pair of arms 144 extending downwardly from a bight portion 146. The slider 26 is movable between the arms 144 and the bight portion 146 and includes a pair of spaced rearwardly facing sockets 25 and 17 as illustrated in FIGS. 19A and 20. The slider 26 also includes the portion 74 that is arranged to engage the guide 30. The spring 32 is positioned between the guide 30 and the portion 76 on the operator 34.

The guide 30 has portions 150 that are engaged by portion 74 on the slider 26 and a bight portion 152 that is engaged by the portion 28 on the operator 34. The operator 34 includes the arms 144, the bight portion 146, the portion 76, a pair of portions 52 and a pair of portions 54 which are engagable with opposite ends of switch cartridges which are inserted into the housing part 134 as will be later described. Additionally the operator 34 includes the portion 28 as well as a pair of suitable sockets 154, shown in FIG. 21 that receive a pair of arms 156 on the latch lever 36. Latch lever 36 is rotatable about the pivot 38 and includes an arm 39. Arm 39 is engagable with the arm 40 on the latch 42. The latch 42 is rotatable about the pivot 44 and includes the arm portion 46 that is engaged by the timing button 14, that is not shown in FIG. 21. A single spring 50 that is positioned between the arm 46 and the arm 39 provides a force which constantly urges the latch lever 36 and the latch 42 to rotate in a counter clockwise direction about pivots 38 and 44 respectively to a position where a stop surface 48 on the latch 42 engages a portion 158 not shown in FIG. 21 and designated as the portion 158 on the housing 134 in FIG. 17. In view of the illustration and description of the slider 26, guide 30, the operator 34, the latch lever 36 and the latch 42 as set forth in connection with FIGS. 1–6, a description of the operation of the components shown and described in connection with FIGS. 17–21 is obvious and therefore will not be repeated.

The timer assembly 132 as shown in FIGS. 22 and 23 is attached to the side wall of the housing part 134 as in FIG. 9. The timer assembly 132 is functionally identical with the timer mechanism that is fully described in the Kiessling U.S. Pat. No. 4,030,054 and a detailed explanation of the structure and operation of assembly 132 is not believe required.

The timer assembly 132 as shown in FIGS. 22 and 23 includes a plunger or timing button 14 that may be moved to the right in FIG. 23 to compress the spring 11 when a force is applied to the button 14. The movement of the button 14 to the left is controlled by the diaphragm 17 which is delayed with a adjustable rate by a valve mechanism that controls the amount of air that is supplied to a chamber as a diaphragm 17 moves to the left in FIG. 23. The timing button 14, not shown in FIG. 21, engages the arm 46 to move the arm in a clock-wise direction and thereby release the engagement between the arm 40 and the arm 39.

Figure 17:
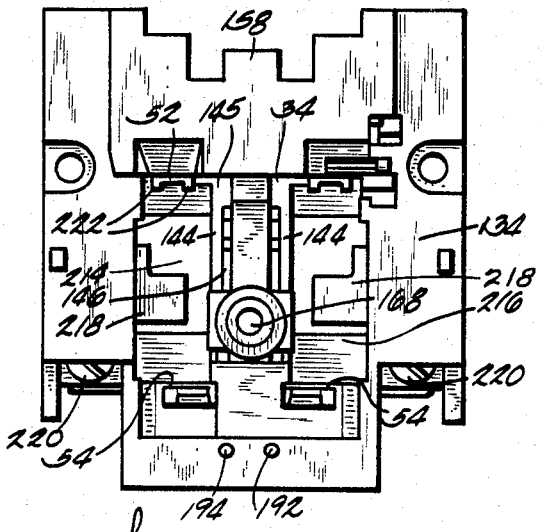
FIGS. 17 is a top or front view of a base assembly as used with the attachment in FIG. 9.
Figure 18:
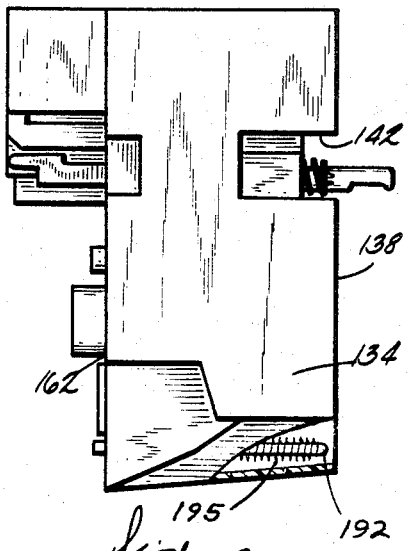
FIG. 18 is a side view of the base assembly in FIG. 17.

The cover 136 has a rear side 160 positioned on a front side 162 of the housing part 134. The cover 136 is maintained in position on the housing part 134 by a screw 164. The screw 164 extends through an opening 166 in the cover 136 and is threaded into an imbedded threaded insert 168 that is located in the front face of the housing part 134 as shown in FIG. 17. The screw 164 as in FIG. 24 is centered at the intersection of a horizontal center line H and a vertical center line V which are so designated in FIG. 24 for reference purposes. Three pairs of openings extend through the cover 136 from a front side to the rear side of the cover 136. A first of the pair of openings, designated as 170A and 170B are located above the horizontal center line H at an equal distance on opposite sides of the vertical center line V. A second of the pair of openings, designated as 172A and 172B, are located below the horizontal center line H and at equal distances on opposite sides of the center line V. A third pair of openings, designated as openings 174A and 174B are centered on the vertical center line V and are spaced from opposite sides of the horizontal center line H. A Slider 180 has a U-shaped channel shape with a pair of arm portions 176 extending from a bight portion 178. The bight portion 178 has an elongated opening 179 which receives a boss 182 with clearance. The boss 182 surrounds the opening 166. The arm portions 176 are equidistantly spaces from and extend parallel to the vertical center line V. The bight portion 178 is positioned adjacent the rear side of the cover 136 and is movable along the vertical center line V.

A front surface 184 on the bight portion 178 that is adjacent the rear side 160 is provided with a pair of legends, one of which is shown as an ON DELAY legend 186 and an OFF DELAY legend, not shown, that are spaced from each other along the vertical center line V the same distance as the vertical distance between openings 174A and 174B so only one legend will be visible from the front side of the cover 136 when the slider 180 is at either of two positions relative to the rear side 160. A pair of oppositely facing inclined surfaces 188 and 190 extend rearwardly from the bight portion 178. The surfaces 188 and 190 are located at opposite sides of the center line V and are positioned to be engaged by a pair of plungers 192 and 194 respectively as shown in FIG. 17. The plungers extend through the housing part 134 and are spaced equidistantly at opposite sides of the center line V. The plungers are biased by springs 195 toward the base assembly 112. As shown in FIGS. 14 and 15, the body portion 114 has a pair of forwardly extending bosses 196 and 198 that are located at the same side of the center line V. The bosses have depressions 196A and 198A respectively located in their front surfaces that are located to be respectively engaged by ends of plungers 192 and 194. Holes 196B and 198B engage rubber snubbers (not shown) which cushion adapter 84 in its contact with relay 80, as shown in FIG. 9. Post 196C engages a hole (not shown) in housing part 134 in order to facilitate alignment of parts 84 and 134 when they are assembled together.

The inclined surfaces 188 and 190, the plungers 192 and 194 and the bosses 196 and 198 are located so the plunger 194 engages the boss 196 and is moved forwardly when the housing part 134 is secured in one of its two positions on the body portion 114. The forward movement of the plunger 194, because of its engagement with the inclined surface 188, causes the slider 180 to move to the position shown in FIG. 26 whereat the legend 186 (ON DELAY) is visible through the opening 174A.

A switch cartridge 59 as shown in FIGS. 1–6 and 27–30 includes the housing 58 wherein the contact carrier or plunger 56 is movable along an axis between two positions where the contacts 70 are movable to engage and be separated from the pair of stationary contacts 72. The stationary contacts 72 are each provided by a U-shaped contact member 202, as shown in FIG. 1, that has an arm portion 204 extending into an interior cavity whereon a contact 72 is secured and a bight portion 206 extending along the exterior of a side wall of the housing 58. The bight portions 206 are biased outward from their associated positions relative to the side walls of the housing 58 by springs, not shown. Also as shown in FIG. 1, the plunger 56 is partly surrounded by a spring seat 208 that has a portion engageable with a portion 210 to limit the relative movement between the plunger 56 and the spring seat 208 in one direction. Movement of the spring seat 208 in a direction opposite the said one direction is opposed by a spring 207 that is positioned between the spring seat 208 and a mid portion of the movable contact support member 212 that has movable contacts 70 secured at its opposite extremities. As shown in FIG. 17 the housing part 134 has a pair of recesses 214 and 216 wherein a switch cartridge 59 may be inserted in either of two positions. When the cartridges 59 are in either position, one of the bight portions 206 will be pressed into contact with a terminal portion 218 that is located at the rear of its associated recess and is electrically part of a wire connecting terminal 220 that is located at the exterior of the housing 58. When a switch cartridge 59 is positioned in the recesses 214 or 216 in one position whereat the end of the plunger having the spring seat 208 is positioned against the portion 54 and the end of the plunger without the spring seat is positioned between a pair of nibs 222 on the portion 52, the plunger 56 is figuratively trapped between the portions 52 and 54 and the switch contacts 70 and 72 will be in a normally closed position as evidenced by the presence of a normal closed contact legend 226 that is visible through the exposed openings 170A and/or 170B when that attachment is programmed to operate in an ON DELAY mode. When the switch cartridges are in the normally closed position, the spring 56 will bias the contact 70 and 72 toward the closed position.

When a switch cartridge 59 is positioned in the recesses 214 or 216 in a second position whereat the end of the plunger 56 having the spring seat 208 is positioned against the portion 52 and the spring seat 208 is engaged by the nibs 222, the end of the plunger 59 will be positioned against the portion 54, and the plunger 59 will be trapped between the portions 52 and 54 and the switch contacts will be at the normally open contact position as evidenced by the presence of a normally open contact legend 224 that is visible through the exposed openings 170A and/or 170B and the attachment 10 is programmed to operate in the ON DELAY mode. When the cartridges are inserted in the recesses 214 and 216 to have a normally open operation, during intervals when the plunger is at an at rest position the contacts 70 and 72 are open. When the plunger 56 is moved to an operated position the nibs 222 will move the spring seat 208 toward the stationary contacts 72 and bias the movable contacts 70 into engagement with the stationary contacts 72.

As most clearly shown in FIGS. 28 and 29 the switch cartridges have accepted normally open contact designations 224 and normally closed contact deaignations 226 or indicia located at corners of the switch housing 58. As shown in FIG. 28 the end of the housing 58 associated with the spring seat 208 has a pair of normally open contact indicia 224 thereon while the end of the housing 58 from which the contact carrier extends without an attendant spring seat 208 has a normally closed contact indicia 226 thereon. Thus when the switch cartridges 59 are inserted into the recesses 214, a normally closed contact indicia 226 or a normally open contact indicia 224 will be selectively exposed at the end of the cartridge 59 associated with the portions 52 and conversely a normally open indicia 224 and a normally closed indicia 226 will be exposed at the end of the cartridge associated with the portion 54.

When the housing part 134 is positioned on the body portion 114 to provide an OFF DELAY or an ON DELAY function and a switch cartridge 59 is inserted into recesses 214 or 216 so the associated spring seat 208 is positioned adjacent the portion 52, the cartridge so positioned will provide a normally open contact operation and a normally open contact indicia 224 will be aligned with an opening 170A or 170B. Conversely when a cartridge 59 is inserted in a recess 214 or 216 so the spring seat 208 of the associated cartridge is positioned adjacent the portion 54, the cartridge 59 so positioned will provide a normally closed operation and an indicia 226 will be aligned with the openings 170A or 170B.

Also when the housing part 134 is positioned on the body portion 114 to provide a time delay after deenergization function, an OFF DELAY legend will appear in opening 174B and a switch cartridge 59 when positioned in the recesses 214 or 216 so the spring seat 208 of the associate cartridge 59 is positioned adjacent the portion 52, the cartridge so positioned, will provide a normally closed operation and the contact indicia 226 will be aligned with an opening 172A or B. Conversely when a cartridge 59 is inserted in a recess 214 or 216, so the spring seat 208 is positioned adjacent the portion 54, the cartridge so positioned will provide a normally open contact operation and an indicia 224 will be aligned with one of the openings 172A or B.

As illustrated in FIGS. 24 and 26, the slider 180 has an OFF DELAY legend, not shown, which is visible through the opening 174B when the slider 180 is at one position along the rear side of the cover 136 and an ON DELAY legend 186 visible through the opening 174A when the slider 180 is positioned as shown in FIG. 26. In addition to the ON and OFF DELAY legends, the slider 180 is provided with two pairs of slats one pair of which is designated as slats 228A and 228B in FIGS. 24 and 26. The slats 228A and 228B extend from opposite sides of the slider 180 and are aligned with and are arranged to obstruct a portion of the openings 172A and 170B while the openings 170 and 170B are unobstructed when the slider 180 is positioned to have the ON DELAY legend 186 visible through the opening 174B. Conversely when the slider 180 is positioned so an OFF DELAY legend is visible through the opening 174B, a second pair of slats 229A and 229B that extend from opposite sides of the slider 180 will be aligned with and arranged to obstruct a portion of the openings 170A and 170B and obscure the indicia aligned with the opening 170A and B from view while the openings 172A and 172B are unobstructed.

As shown in FIG. 26 the slider 180 has portions 230 extending outwardly from its arm portions 176. The portions 230 are positioned between the rear wall of the cover 136 and a pair of terminal members 232 to maintain the assembly between the slider 180 and the cover 136. The terminal members 232 are formed as a substantially flat metal part to have a portion 234 that overlays the portions 230 and a terminal portion 236 that is exposed at the front side of the attachment 10. The portions 236 have threaded openings receive terminal clamps and screws 238 that are used to secure an exposed end of a wire conductor, not shown, to the attachment 10.

The timing attachment 10, when mounted on the front side of the relay 80, completely conceals all moving components of the relay 80 from view and thereby prevents a visual indication of the operative state of the relay 80. To overcome this deficiency, the attachment 10 is provided with an indicating means including a spring biased plunger 240 shown in FIGS. 10 and 11. The plunger 240, which is constantly biased rearwardly toward the relay 80 by a spring 242. The plunger 240 extends from a portion of the plunger 240 that is visible at the front of the attachment 10 through a suitable passage in the housing part 134, one of the pair of holes 244 in the body portion 114 (shown in FIG. 14) and one of a pair of holes 246 in the adapter 84 (shown in FIG. 12) into engagement with front surface portions on the arms 104 (FIG. 13). The plunger 240 is biased rearwardly by the spring 242 so that energization of the relay 80 causes the plunger 240 to move rearwardly in the housing part 134 to reduce the visibility of the plunger 240 when viewed from the front side of the attachment 10. Further if desired the plunger 240 through the use of a suitable tool, such as a screwdriver, can be manually operated to manually simulate the operation of the relay 80 and the attachment 10.

Figure 10:
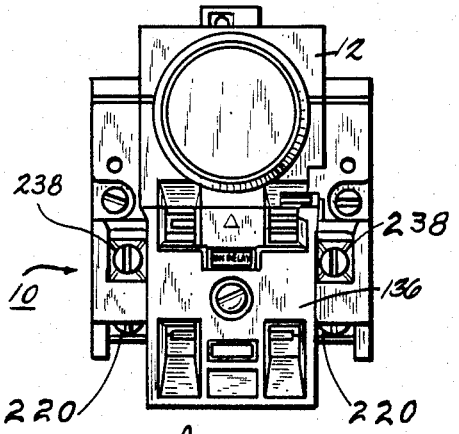
FIG. 10 is a top view of the attachment as shown in FIG. 7.
Figure 11:
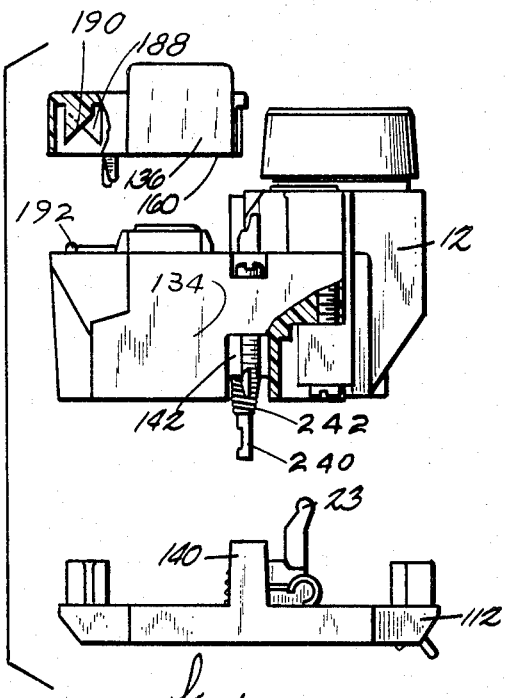
FIG. 11 is an exploded side view of the components of the attachment when they are separated from each other.

As disclosed in the U.S. application Ser. No. 411,387, now issued as U.S. Pat. No. 4,479,102 on Oct. 23, 1984 supra and shown in FIGS. 7 and 8, the basic relay 15 has input and output terminals located along its upper and lower sides so the relay 15 may be considered as a through wiring device. As previously described the timing attachment 10 has the pair of terminals 220 along one of its sides and terminal screws 238 positioned as shown in FIG. 10 to be accessible for wiring purposes along a side of the attachment 10 that is opposite the side from which the terminals 220 are located so the attachment 10 also may be considered as a through wiring device.

While certain preferred embodiments of the invention have been specifically disclosed, it is understood that the invention is not limited therto, as many variations will be readily apparent to those skilled in the art and the invention is to be given its broadest possible interpretation within the terms of the following claims.

We claim:

1. A timer attachment for an electromagnetically operated device wherein the device includes:

a housing having a front end and a member that is movable in the housing from an at rest position to an operated position in response to an energization of an electromagnet, said attachment comprising:

a housing part secured at the front end of the device housing in either of two selected positions, an operator movable along an axis in the housing part, means in the housing part for translating movement of the member to the operator for causing the operator to move from a first position to a second position an adjusted interval after the member is moved from the at rest position to the operated position when the housing part is secured at the front end of the housing in one of the two selected positions and for causing the operator to move from the second position to the first position an adjustable interval after the member moves from the operated position to the at rest position when the housing part is secured at the front end of the housing in a second of the two selected positions, a cover secured at a front end of the housing part, a slider mounted for movement adjacent a rear surface of the cover, said slider having a pair of spaced advisory legends on a front surface that is adjacent the rear surface of the cover with the distance between the legends equal to a distance between a pair of openings in the cover, a pair of oppositely facing inclined surfaces extending rearwardly from a rear surface of the slider, and a pair of individually operable plungers extending through the housing part with each of the plungers having a first end engagable with one of the inclined surfaces and a second end engageable with portions of the housing for actuating one of the plungers and moving the slider in a first direction when the housing part is secured to the housing in the first position and actuating a second one of the two plungers and moving the slider in a direction opposite the first direction when the housing part is mounted in the second position.

2. The timer attachment as recited in claim 1 wherein the legend on the slider indicates the position of the housing part on the housing when the attachment is in either of its two selected positions.

3. The timer attachment as recited in claim 2 wherein the legends indicate when the attachment is selectively positioned to provide an ON delay timing function and an OFF delay timing function.

4. The timer attachment as recited in claim 1 wherein the plungers are biased by springs toward engagement with the housing.

5. The timer attachment as recited in claim 2 wherein the inclined surfaces are located on opposite sides of a plane.

6. The timer attachment as recited in claim 5 wherein the plungers extend along parallel axis that are spaced equidistantly on opposite sides of the plane.

7. The timer attachment as recited in claim 6 wherein a pair of abutments extending forwardly from a front face of the housing are positioned so one of the plungers engages one of the abutments when the housing part is secured in one of the two selected positions on the housing and the other plunger engages the other of the two abutments when the housing part is secured in the other of the two selected positions on the housing.

8. The timer attachment as recited in claim 7 wherein the abutments are spaced equidistantly from the plane.

9. The timer attachment as recited in claim 8 wherein the housing part includes a pair of parallel sockets extending axially along and spaces equidistantly at opposite sides of the plane, a pair of switch cartridges inserted into the sockets in either of two positions with the switches having plungers movable by the operator in either of two directions and indicia visible of external surfaces of the cartridges indicating two different modes of contact operation of the cartridges when the cartridges are inserted into the sockets in either of two positions, the cover includes openings for viewing the indicia on the cartridges and the slider includes slats for obscuring selected ones of the indicia when the housing part is secured in either of the selected positions on the housing.

10. A timer attachment for an electromagnetically operated device wherein the device includes:

a housing having a side and a member that is movable in the housing from an at rest position to an operated position in response to an energization of an electromagnet, said attachment comprising:

a housing part secured to a side of the housing in either of two selected positions, an operator movable along an axis in the housing part, means in the housing part for translating movement of the member to the operator for causing the operator to move from a first position to a second position an adjustable interval after the member is moved from the at rest position to the operated position when the housing part is secured at the side of the housing in one of the two selected positions and for causing the operator to move from the second position to the first position an adjustable interval after the member moves from the operated position to the at rest position when the housing part is secured to the side of the housing in a second of the two selected positions, a cover secured on a side of the housing part, a slider mounted for movement adjacent a underside surface of the cover, said slider having a pair of spaced advisory legends on a surface that is adjacent the underside of the cover with the distance between the legends equal to a distance between a pair of openings in the cover, a pair of oppositely facing inclined surfaces extending toward the side of the housing from an underside surface of the slider, and a pair of individually operable plungers extending through the housing part with each of the plungers having a first end engagable with one of the inclined surfaces and a second end engageable with portions of the housing for actuating one of the plungers and moving the slider in a first direction when the housing part is secured to the housing in the first position and actuating a second one of the two plungers and moving the slider in a direction opposite the first direction when the housing part is mounted in the second position.

11. A timer attachment for an electromagnetically operated device wherein the device includes:

a housing having a front end and a member that is movable in the housing from an at rest position to an operated position in response to an energization of an electromagnet, said attachment comprising:

a housing part secured at the front end of the housing in either of two selected positions, an operator movable along an axis in the housing part, means in the housing part for translating movement of the member to the operator for causing the operator to move along an axis from a first position to a second position an adjustable interval after the member moves from the at rest position to the operated position when the housing part is secured at the front end of the housing in one of the two selected positions and for causing the operator to move along the axis from the second position to the first position an adjustable interval after the member moves from the operated position to the at rest position when the housing part is secured at the front end of the housing in a second of the two selected positions, a pair of parallel sockets extending axially along and spaced equidistantly on opposite sides of the axis, a pair of switch cartridges inserted into the sockets in either of two positions with the switches having plungers movable by the operator in either of two directions and indicia visible on external surfaces of the cartridges indicating two different modes of contact operation of the cartridges when the cartridges are inserted into the sockets in either of the two positions, a cover secured at a front end of the housing part, said cover having openings extending through the cover from a front side of the cover to a rear side of the cover including openings for viewing the indicia, a slider mounted for movement adjacent the rear side of the cover, said slider having a pair of spaced advisory legends on a front surface that is adjacent the rear side of the cover with the distance between the legends equal to a distance between a pair of the openings in the cover, a pair of oppositely facing inclined surfaces extending rearwardly from a rear surface of the slider, a pair of individually operable plungers extending through the housing part with each of the plungers having a first end engagable with one of the inclined surfaces and a second end engageable with portions of the housing for actuating one of the plungers and moving the slider in a first direction when the housing part is secured to the housing in the first position and actuating a second one of the two plungers and moving the slider in a direction opposite the first direction when the housing part is mounted in the second position said inclined surfaces and advisory legends having a position on the slider for exposing one of the legends through an opening in the cover when the slider is positioned by the inclined surfaces at a first position and exposing a second one of the legends when the slider is positioned by the inclined surfaces at a second position, and a first pair of slats extending in opposite directions from the slider for obscuring a first pair of openings in the cover and a first pair of indicia when the slider is in the first position and a second pair of slats extending in opposite directions from the slider for obscuring a second pair of openings in the cover and a second pair of indicia.

12. The timer attachment as recited in claim 11 wherein the legend on the slider indicates the position of the housing part on the housing when the attachment is in either of its two selected positions.

13. The timer attachment as recited in claim 12 wherein the legends indicate when the attachment is selectively positioned to provide an ON delay timing function and an OFF delay timing function.

14. The timer attachment as recited in claim 11 wherein the plungers are biased by springs toward engagement with the housing.

15. The timer attachment as recited in claim 11 wherein the inclined surfaces are located on opposite sides of a plane.

16. The timer attachment as recited in claim 15 wherein the plungers extend along parallel axis that are spaces equidistantly on opposite sides of the plane.

17. The timer attachment as recited in claim 16 wherein a pair of abutments extending forwardly from a front face of the housing are positioned so one of the plungers engages one of the abutments when the housing part is secured in one of the two selected positions on the housing and the other plunger engages the other of the two abutments when the housing part is secured in the other of the two selected positions on the housing.

18. The timer attachment as recited in claim 17 wherein the abutments are spaced equidistantly from the plane.

19. The timer attachment as recited in claim 18 wherein the housing part includes a pair of parallel sockets extending axially along and spaced equidistantly at opposite sides of the plane, a pair of switch cartridges inserted into the sockets in either of two positions with the switches having plungers movable by the operator in either of two directions and indicia visible on external surfaces of the cartridges indicating two different modes of contact operation of the cartridges when the cartridges are inserted into the sockets in either of two positions, the cover includes openings for viewing the indicia on the cartridges and the slider includes slats for obscuring selected ones of the indicia when the housing part is secured in either of the selected positions on the housing.

* * * * *